US007592549B2

(12) United States Patent
Seufert et al.

(10) Patent No.: US 7,592,549 B2
(45) Date of Patent: Sep. 22, 2009

(54) HYBRID CABLE

(75) Inventors: Alexander Seufert, Hammelburg (DE); Peter Krautwald, Wiesthal (DE); Tanja Taupitz, Gemuenden (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/768,367

(22) Filed: Jun. 26, 2007

(65) Prior Publication Data

US 2008/0041622 A1 Feb. 21, 2008

(30) Foreign Application Priority Data

Jun. 30, 2006 (DE) ..... 10 2006 030 180

(51) Int. Cl.
*H01B 7/34* (2006.01)

(52) U.S. Cl. ..... 174/113 R

(58) Field of Classification Search ..... 174/113 R
See application file for complete search history.

(56) References Cited

U.S. PATENT DOCUMENTS 6,249,913 B1 * 6/2001 Galipeau et al. ..... 725/76
6,448,500 B1 * 9/2002 Hosaka et al. ..... 174/113 R
7,038,138 B2 * 5/2006 Laity et al. ..... 174/113 R
2003/0121694 A1 * 7/2003 Grogl et al. ..... 174/113 R

FOREIGN PATENT DOCUMENTS

DE 20 2005 008 731 8/2005

* cited by examiner

*Primary Examiner*—Chau N Nguyen
(74) *Attorney, Agent, or Firm*—Michael J. Striker

(57) ABSTRACT

A hybrid cable for electrical drives has at least one signal line, power lines for supplying a drive with electrical power, at least one additional line, an inner electrical shield in which the signal line configured as an electrical line is enclosed, the power line and the at least one additional line being located on a periphery of the inner electrical shield, an outer electrical shield which encloses the power line and the additional line, and at least two shield wires located between the outer shield and the inner shield thereby resulting in improved shielding and mechanical separation between the power lines and the additional lines.

9 Claims, 1 Drawing Sheet

HYBRID CABLE

CROSS-REFERENCE TO A RELATED APPLICATION

The invention described and claimed hereinbelow is also described in German Patent Application DE 10 2006 030 180.3 filed on Jun. 30, 2006. This German Patent Application, whose subject matter is incorporated here by reference, provides the basis for a claim of priority of invention under 35 U.S.C. 119(a)-(d).

BACKGROUND OF THE INVENTION

The present invention relates to a hybrid cable. A hybrid cable according to the present invention refers to a cable that is used to transmit communication signals as well as power.

Hybrid cables that use different transmission media, e.g., optical waveguides and copper, and hybrid cables for transmitting highly diverse electrical voltages are known.

A hybrid cable is shown, e.g., in utility patent DE 20 2005 008 731 U1. It includes shielded electrical lines in the cable core for power supply, and control signal lines located on the outer periphery of the shield, together with an optical waveguide. The different groups of signal lines and power supply lines are spacially separated from each other. If one of the power supply lines is used for signal transmission, or if one of the signal lines is used for power supply, disturbing influences result between the lines that are not electrically shielded against each other. The power supply lines, which are typically surrounded by strong electrical fields, can cause electrical signals to become corrupted, or, if a short circuit occurs between the lines, the connected device can be destroyed.

SUMMARY OF THE INVENTION

The object of the present invention is to design a hybrid cable for electrical drives that provides the best possible shielding between power supply lines and signal lines, while ensuring that the connected peripheral devices are protected against a short circuit.

The object is attained by the present invention using a hybrid cable for electrical drives with at least one signal line and power lines for supplying the drive with electrical power, and at least one additional line. The signal line is an electrical line enclosed in an inner electrical shield, and the power line and the at least one additional line are located on the periphery of the inner electrical shield. The power line and additional line are enclosed in an outer electrical shield, and at least two shieldwires are located between the outer and inner shields, thereby providing shielding and mechanical separation between power lines and additional lines.

The present invention therefore provides a hybrid cable for realizing the intermediate circuit wiring of an electrical drive and for establishing a signal connection between control and drive, e.g., to realize control communication. The advantage of the design is that it makes it possible to use a single cable instead of two different cables, i.e., one cable for power supply, and another cable for signal transmission. This reduces wiring complexity and costs. The inventive shielding makes it possible to decouple low voltage lines and power supply lines at a later point in time.

Given that shieldwires are located between the low voltage lines and power lines, the additional lines are also mechanically separated from each other, thereby preventing—to the greatest extent possible—a short circuit between additional lines and power lines, and mutual influence by electrical and/or magnetic fields. Possible malfunctions of the connected peripheral devices are therefore minimized, and wiring costs are reduced. The present invention also provides a certain amount of redundancy in terms of wiring. This redundancy makes it possible to wire a drive and shield the newly wired, electrical signal-carrying lines at a later point in time. A drive system wired with the inventive hybrid cable can therefore be handled in a highly flexible manner.

When the cross sections of the shieldwires are increased and their insulation strengths reduced, the shielding is improved, due to an increased copper space factor. When the shieldwires are replaced with a large number of lines with a small cross section, the copper space factor in the line cross section also becomes greater, thereby also improving the shielding.

The signal line is preferably used to carry field bus signals. The present invention prevents a disruption of the field bus signals (transmission of setpoint values and actual values for the drive), thereby increasing functional security.

Particularly preferably, the power line is designed to carry an intermediate circuit voltage. With an intermediate circuit voltage in particular, which is typically a direct voltage, strong static electrical fields occur, which can interfere with other signals. A short circuit between the power lines and the additional lines, which are reserved, e.g., for control signals, would destroy the electronics of the connected peripheral devices. The present invention prevents such a destruction by preventing a short circuit as described above.

Most particularly preferably, the additional line includes several cables for carrying low voltages. Further control and regulating signals can therefore be transmitted—in addition to the signal lines—and it is possible to optimally decouple them from the electrical fields produced via the power lines.

It is also preferable that all lines are enclosed in an outer jacket. This outer jacket mechanically holds the cable together and serves simultaneously as insulation and protection.

A plug-in connector (plug/socket) is preferably located on one end of the cable. The cable can therefore be detachably connected with the drive controller and/or the peripheral devices. The electrical connection between the shields and the shieldwires can be realized using the plug-in connector via a wiring in the plug-in connector itself, or on a printed circuit board of the connected peripheral devices.

The present invention also relates to an electrical drive with the inventive hybrid cable for supplying the drive with electrical power and for control communication; the outer and inner shields and ground lines have the same electrical potential, thereby resulting in improved electrical shielding of the power lines against the additional lines. The drive can be easily wired, thereby ensuring power supply and control communication, and ensuring that operational readiness is quickly established. The electrical circuits of the drive are also protected against overvoltages. Wiring and electrical shielding can be implemented at any later point in time, e.g., when a feedback unit is connected.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
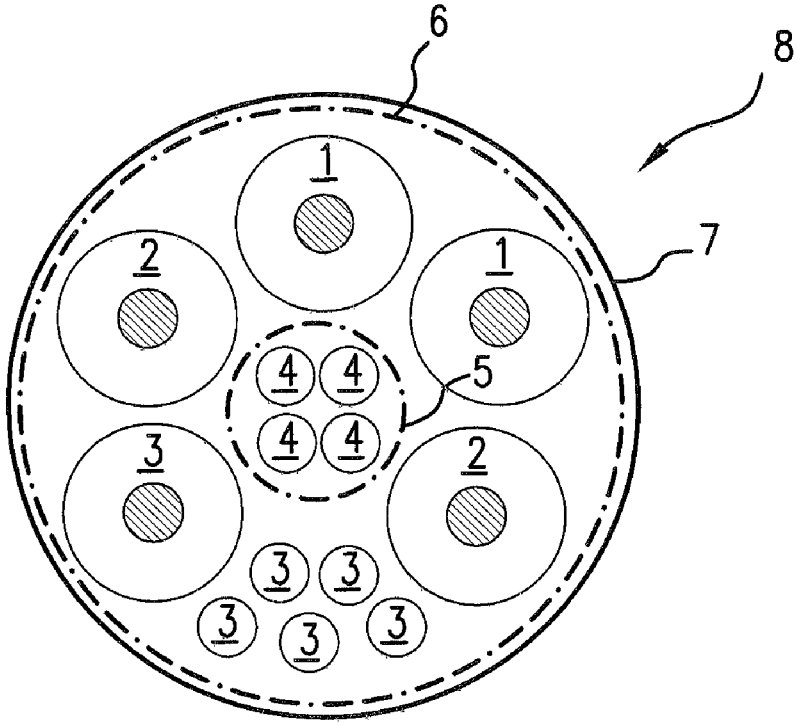
FIG. 1 is a view showing a cross-section of a hybrid cable in accordance with the present invention.

FIG. 1 shows a cross section of an inventive hybrid cable 8. Also shown are an outer jacket 8, an outer shield 6, power lines 1, shieldwires 2, additional lines 3, an inner shield 5, and signal lines 4.

Inventive hybrid cable 8 is similar in design to a coaxial cable. In this case, the inner line is composed of several signal lines 4, which are enclosed in an inner shield 5. Further lines 1, 2, 3 are distributed between inner shield 5 and outer shield 6, around the outer periphery of inner shield 4. Lines 1, 2, 3 are used to transmit power, i.e., to operate an electrical device connected with a power supply via hybrid cable 8, and to transmit low voltage (e.g., control signals) using additional lines 3.

Shieldwires 2 located between power supply lines 1 and low voltage cables 3 serve to mechanically separate and electrically shield power lines 1 against low voltage cables 3. The mechanical separation is ensured due to the dimensions of the shieldwires, which essentially fill the entire radial intermediate space between the inner shield and the outer shield. If any of the power lines 1 breaks, a short circuit between power line 1 and additional line 3 is prevented, due exclusively to the existence of shieldwire 2. If the same electrical potential is applied to ground lines 2 as to shieldwires 4, 5, preferably 0 volts or ground, the electrical field lines emerging from power lines 1 find their end point on shieldwire 2 and surrounding shields 4, 5.

The additional lines are therefore no longer exposed to the electrical fields emerging from power lines 1. Mutual electrical influence is largely prevented. If the copper density with ground potential between power line 1 and additional lines 3 is increased, e.g., by reducing the thickness of the insulating wall and/or increasing the cross section of shieldwire 2, the shielding effect is improved. A single shieldwire 2 could also be replaced with several shieldwires 2 having a smaller line cross section.

In the inventive application, signal line 4 is used to carry field bus signals, and power line 1 is used to carry the intermediate circuit direct voltage to supply a drive controller with electrical power. Additional lines 3 also serve to carry low voltages (e.g., feedback signals). Further control and regulating signals can therefore be transmitted—in addition to signal lines 4—and it is possible to optimally decouple them from the electrical fields produced via power lines 1, using shieldwires 2. Outer jacket 7 mechanically reinforces the cable and serves simultaneously as insulation and protection. Inventive hybrid cable 8 includes a plug-in connector (plug or socket) on at least one end of the cable for connection to the drive controllers. The potentials of shieldwires 2 and the shields are typically created on a printed circuit board of the drive controller. The potentials could also be combined inside the plug-in connection.

Figure 2:
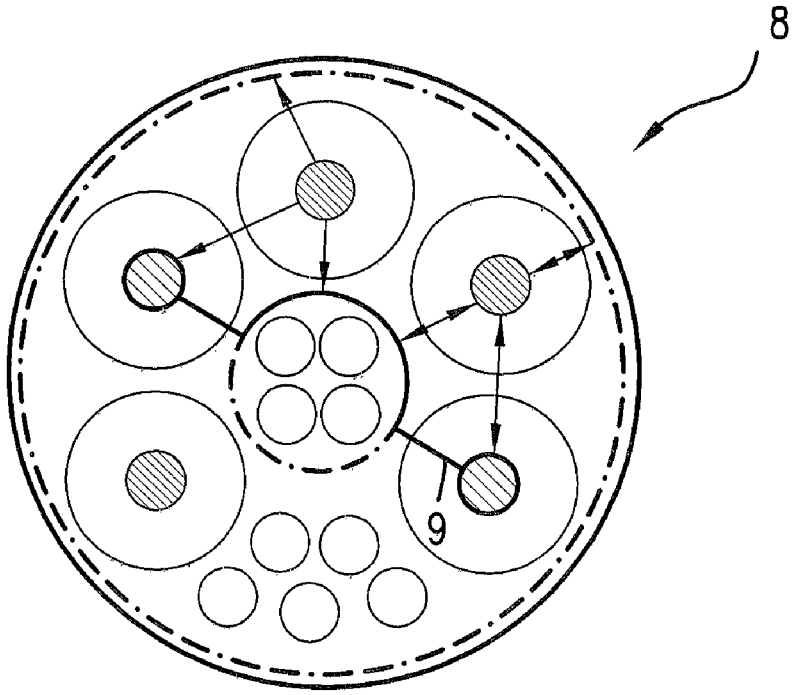
FIG. 2 is a view showing an inventive effect on the hybrid cable in accordance with the present invention as shown in FIG. 1.

FIG. 2 shows the inventive effect on the cable shown in FIG. 1. The present invention results in the formation of potential lines 9, which result in improved shielding.

It will be understood that each of the elements described above, or two or more together, may also find a useful application in other types of constructions differing from the type described above.

While the invention has been illustrated and described as embodied in a hybrid cable, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

The invention claimed is:

1. A hybrid cable for electrical drives, comprising at least one signal line; power lines for supplying a drive with electrical power; at least one additional line; an inner electrical shield in which said signal line configured as an electrical line is enclosed, said power line and said at least one additional line being located on a periphery of said inner electrical shield; an outer electrical shield which encloses said power line and said additional line; and at least two shield wires located between said outer shield and said inner shield thereby resulting in improved shielding and mechanical separation between said power lines and said additional lines, wherein the shieldwires are dimensioned to essentially fill an entire radial intermediate space between the inner shield and the outer shield to ensure said mechanical separation between said power lines and said additional lines, wherein the shieldwires are configured such that cross sections of the shieldwires are increased while insulation thickness of the shieldwires are reduced, whereby the shielding is improved based on an increased copper space factor.

2. A hybrid cable as defined in claim 1, wherein said signal line is configured to carry field bus signals.

3. A hybrid cable as defined in claim 1, wherein said power line is configured to carry an intermediate circuit voltage.

4. A hybrid cable as defined in claim 1, wherein said additional line includes cables for carrying lower voltages.

5. A hybrid cable as defined in claim 1; and further comprising an outer jacket enclosing all said lines.

6. A hybrid cable as defined in claim 1; and further comprising a plug-in connector located on one end of the cable.

7. An electrical drive, comprising a hybrid cable including at least one signal line, power lines for supplying a drive with electrical power, at least one additional line; an inner electrical shield in which said signal line configured as an electrical line is enclosed, said power line and said at least one additional line being located on a periphery of said inner electrical shield; an outer electrical shield which encloses said power line and said additional line, and at least two shield wires located between said outer shield and said inner shield thereby resulting in improved shielding and mechanical separation between said power lines and said additional lines, wherein the shieldwires are dimensioned to essentially fill an entire radial intermediate space between the inner shield and the outer shield, wherein the shieldwires are configured such that cross sections of the shieldwires are increased while insulation thickness of the shieldwires are reduced, whereby the shielding is improved based on an increased copper space factor.

8. An electrical drive as defined in claim 7, wherein said outer and said inner shields and ground lines have a same electrical potential, thereby resulting in improved electrical shield of said power lines against said additional lines.

9. A hybrid cable for electrical drives, comprising at least one signal line; power lines for supplying a drive with electrical power; at least one additional line; an inner electrical shield in which said signal line configured as an electrical line is enclosed, said power line and said at least one additional line being located on a periphery of said inner electrical shield; an outer electrical shield which encloses said power line and said additional line; and at least two shield wires located between said outer shield and said inner shield thereby resulting in improved shielding and mechanical separation between said power lines and said additional lines, wherein the shieldwires are dimensioned to essentially fill an entire radial intermediate space between the inner shield and the outer shield to ensure said mechanical separation between said power lines and said additional lines, wherein each of said at least two shieldwires include a plurality of smaller cross-section lines, wherein each of said smaller cross-section lines are configured to have minimal cross sections, thereby increasing a copper space factor and improving the shielding.

* * * * *